US009981469B2

(12) United States Patent
Sano

(10) Patent No.: US 9,981,469 B2
(45) Date of Patent: May 29, 2018

(54) LIQUID DISCHARGE APPARATUS AND PIEZOELECTRIC-ACTUATOR DRIVING DEVICE

(71) Applicant: Takeshi Sano, Kanagawa (JP)

(72) Inventor: Takeshi Sano, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/335,779

(22) Filed: Oct. 27, 2016

(65) Prior Publication Data

US 2017/0136767 A1 May 18, 2017

(30) Foreign Application Priority Data

Nov. 12, 2015 (JP) ..... 2015-221859

(51) Int. Cl.
*B41J 2/045* (2006.01)

(52) U.S. Cl.
CPC ..... *B41J 2/04588* (2013.01); *B41J 2/04563* (2013.01); *B41J 2/04581* (2013.01)

(58) Field of Classification Search
CPC . B41J 2/04581; B41J 2/04588; B41J 2/04563
See application file for complete search history.

(56) References Cited

U.S. PATENT DOCUMENTS

2002/0023622 A1* 2/2002 Rueger ..... F02D 41/2096 123/490
2004/0104965 A1* 6/2004 Mitsuzawa ..... B41J 2/04563 347/43
2006/0067719 A1* 3/2006 Karasawa ..... G03G 15/065 399/44
2007/0132816 A1* 6/2007 Ota ..... B41J 2/17509 347/85
2009/0194025 A1* 8/2009 Jeong ..... B41J 2/0454 118/712
2010/0315451 A1* 12/2010 Bansyo ..... B41J 2/04561 347/6
2011/0221820 A1* 9/2011 Shibata ..... B41J 2/04563 347/17
2013/0162708 A1* 6/2013 Hanagami ..... B41J 2/072 347/10
2015/0077475 A1 3/2015 Mizukami et al.

FOREIGN PATENT DOCUMENTS

JP 2006-321200 11/2006
JP 2006321200 A * 11/2006
JP 2010-194834 9/2010
JP 2013-199026 10/2013

* cited by examiner

*Primary Examiner* — Sharon A Polk
(74) *Attorney, Agent, or Firm* — Cooper & Dunham LLP

(57) ABSTRACT

A liquid discharge apparatus includes a liquid discharge head, a temperature detector, and a bias voltage applying unit. The liquid discharge head includes a piezoelectric element to generate pressure to discharge liquid through a nozzle. The temperature detector detects a temperature correlating to a temperature of the piezoelectric element. The bias voltage applying unit applies a bias voltage to a first electrode of the piezoelectric element opposite a second electrode to which a drive signal is applied. The bias voltage applying unit changes the bias voltage according to a detection result of the temperature detector.

18 Claims, 11 Drawing Sheets

LIQUID DISCHARGE APPARATUS AND PIEZOELECTRIC-ACTUATOR DRIVING DEVICE

CROSS-REFERENCE TO RELATED APPLICATION

This patent application is based on and claims priority pursuant to 35 U.S.C. § 119(a) to Japanese Patent Application No. 2015-221859 filed on Nov. 12, 2015 in the Japan Patent Office, the entire disclosure of which is hereby incorporated by reference herein.

BACKGROUND

Technical Field

Aspects of the present disclosure relate to a liquid discharge apparatus and a piezoelectric-actuator driving device.

Related Art

A piezoelectric actuator used as a pressure generator of a liquid discharge head may include a piezoelectric element driven in a bending vibration mode.

In driving a piezoelectric element of a liquid discharge head in the bending vibration mode, a bias voltage is applied to an electrode at an opposite side of an electrode to which a drive waveform voltage is applied. When the bias voltage is applied to a piezoelectric actuator that does not discharge droplets, for example, the bias voltage is changed on application of the drive waveform voltage.

The bias voltage applied to the piezoelectric actuator may be set to, for example, a value at which the amount of displacement of the piezoelectric actuator is at maximum or approximately maximum.

SUMMARY

In an aspect of the present disclosure, there is provided a liquid discharge apparatus that includes a liquid discharge head, a temperature detector, and a bias voltage applying unit. The liquid discharge head includes a piezoelectric element to generate pressure to discharge liquid through a nozzle. The temperature detector detects a temperature correlating to a temperature of the piezoelectric element. The bias voltage applying unit applies a bias voltage to a first electrode of the piezoelectric element opposite a second electrode to which a drive signal is applied. The bias voltage applying unit changes the bias voltage according to a detection result of the temperature detector.

In another aspect of the present disclosure, there is provided a piezoelectric-actuator driving device that includes a piezoelectric actuator, a temperature detector, and a bias voltage applying unit. The piezoelectric actuator includes a piezoelectric element. The temperature detector detects a temperature correlating to a temperature of the piezoelectric element. The bias voltage applying unit applies the bias voltage to a first electrode of the piezoelectric element opposite a second electrode to which a drive signal is applied. The bias voltage is a reverse bias voltage with respect to the piezoelectric element. The bias voltage applying unit changes the bias voltage according to a detection result of the temperature detector.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
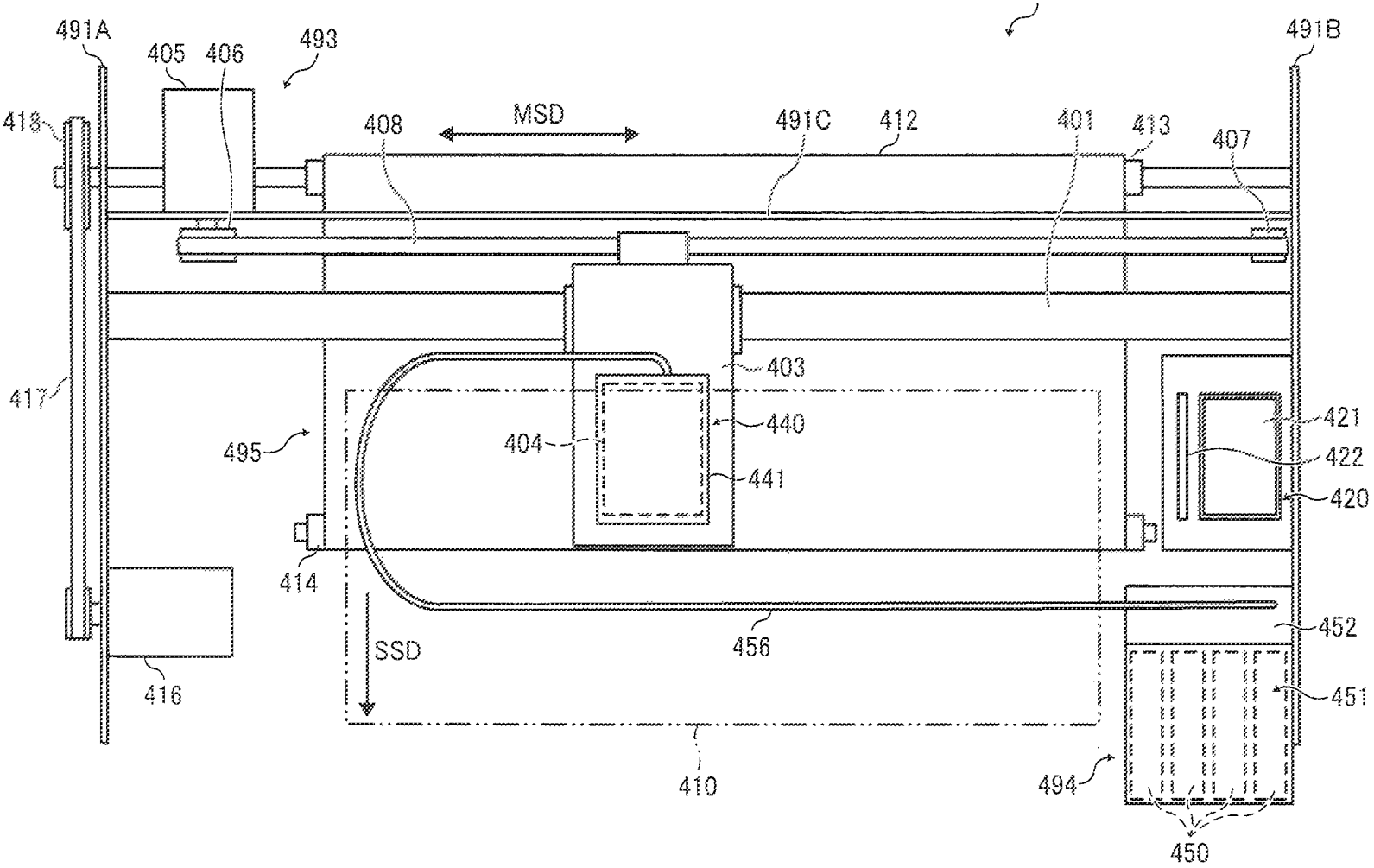
FIG. 1 is a plan view of a portion of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
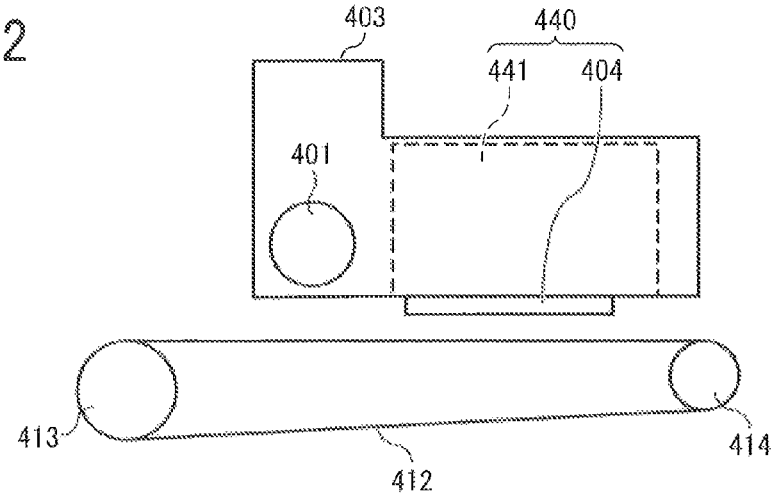
FIG. 2 is a side view of a portion of the liquid discharge apparatus of FIG. 1 including a liquid discharge device.
Figure 3:
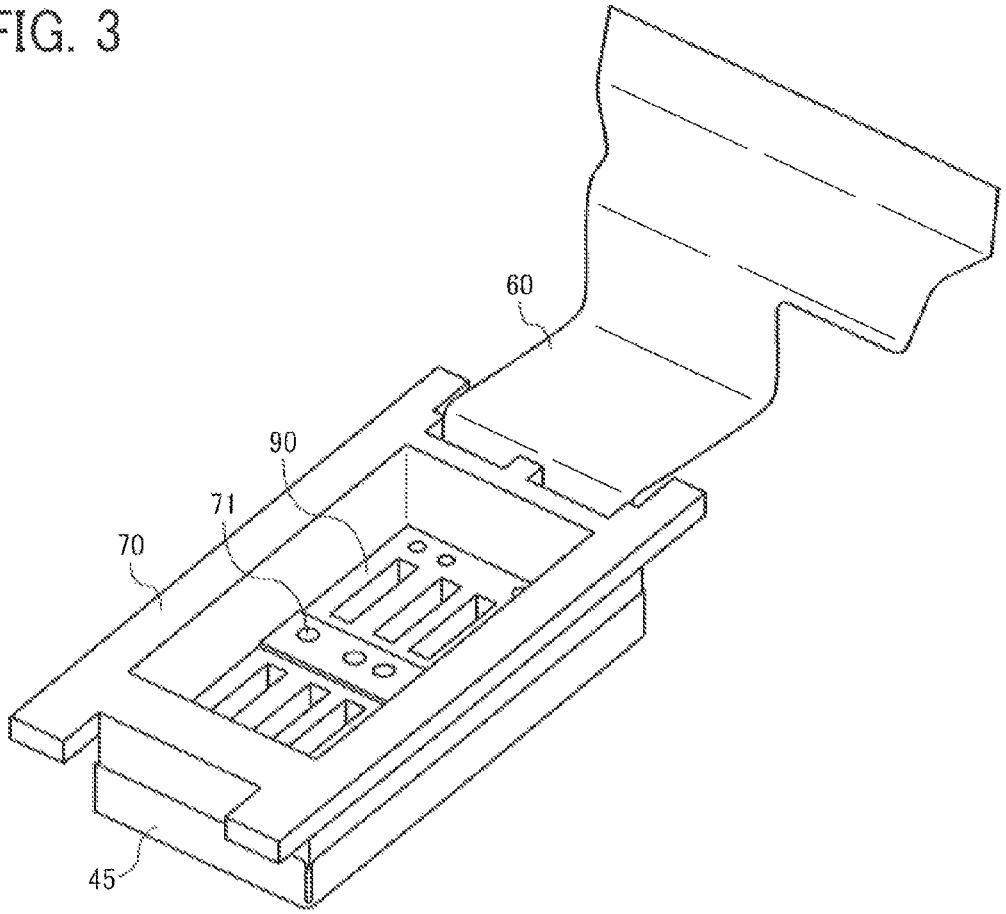
FIG. 3 is an exploded perspective view of a liquid discharge head according to an embodiment of the present disclosure.

Referring now to the drawings, wherein like reference numerals designate identical or corresponding parts throughout the several views, embodiments of the present disclosure are described below. First, a liquid discharge apparatus according to an embodiment of this disclosure is described with reference to FIGS. 1 and 2. FIG. 1 is a plan view of a portion of the liquid discharge apparatus according to an embodiment of the present disclosure. FIG. 2 is a side view of a portion of the liquid discharge apparatus of FIG. 1.

A liquid discharge apparatus 100 according to the present embodiment is a serial-type apparatus in which a main scan moving unit 493 reciprocally moves a carriage 403 in a main scanning direction indicated by arrow MSD in FIG. 1. The main scan moving unit 493 includes. e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning, direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 1, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 100 includes a conveyance unit 495 to convey a sheet material 410. The conveyance unit 495 includes a conveyance belt 412 as a conveyor and a sub-scanning motor 416 to drive the conveyance belt 412.

The conveyance belt 412 electrostatically attracts the sheet material 410 and conveys the sheet material 410 at a position facing the liquid discharge head 404. The conveyance belt 412 is an endless belt and is stretched between a conveyance roller 413 and a tension roller 414. The sheet material 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, a sheet material 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet material 410 stopped, thus forming an image on the sheet material 410.

Figure 4:
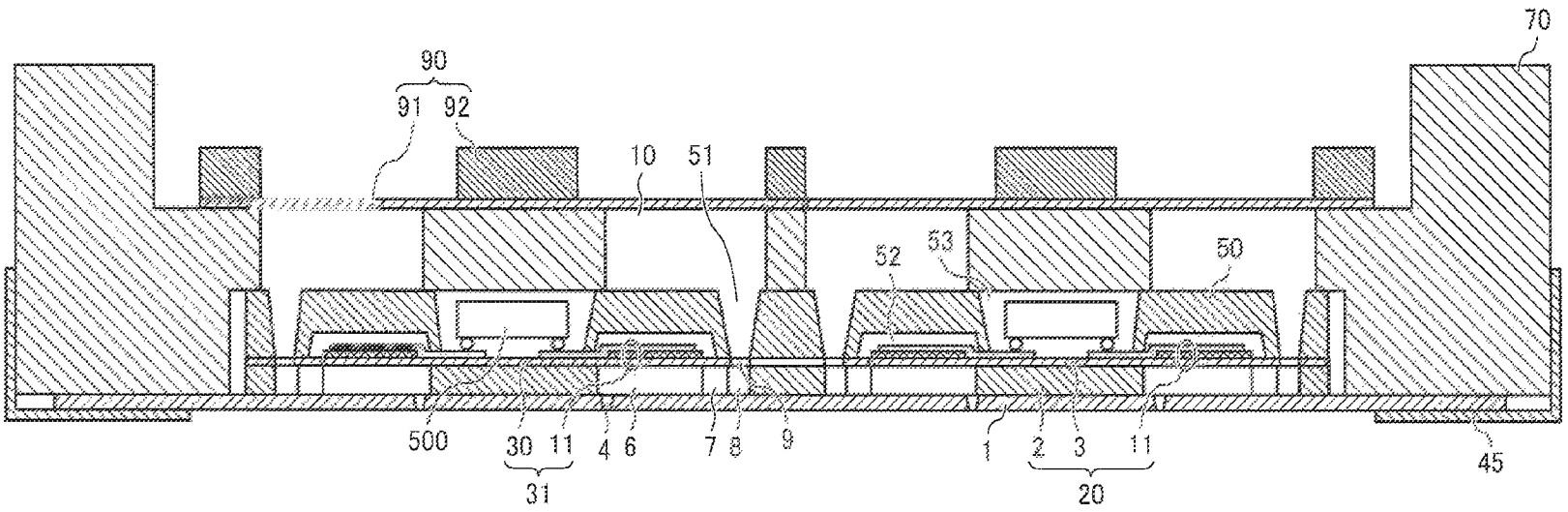
FIG. 4 is a cross-sectional view of the liquid discharge head of FIG. 3 cut along a direction perpendicular to a nozzle array direction.
Figure 5:
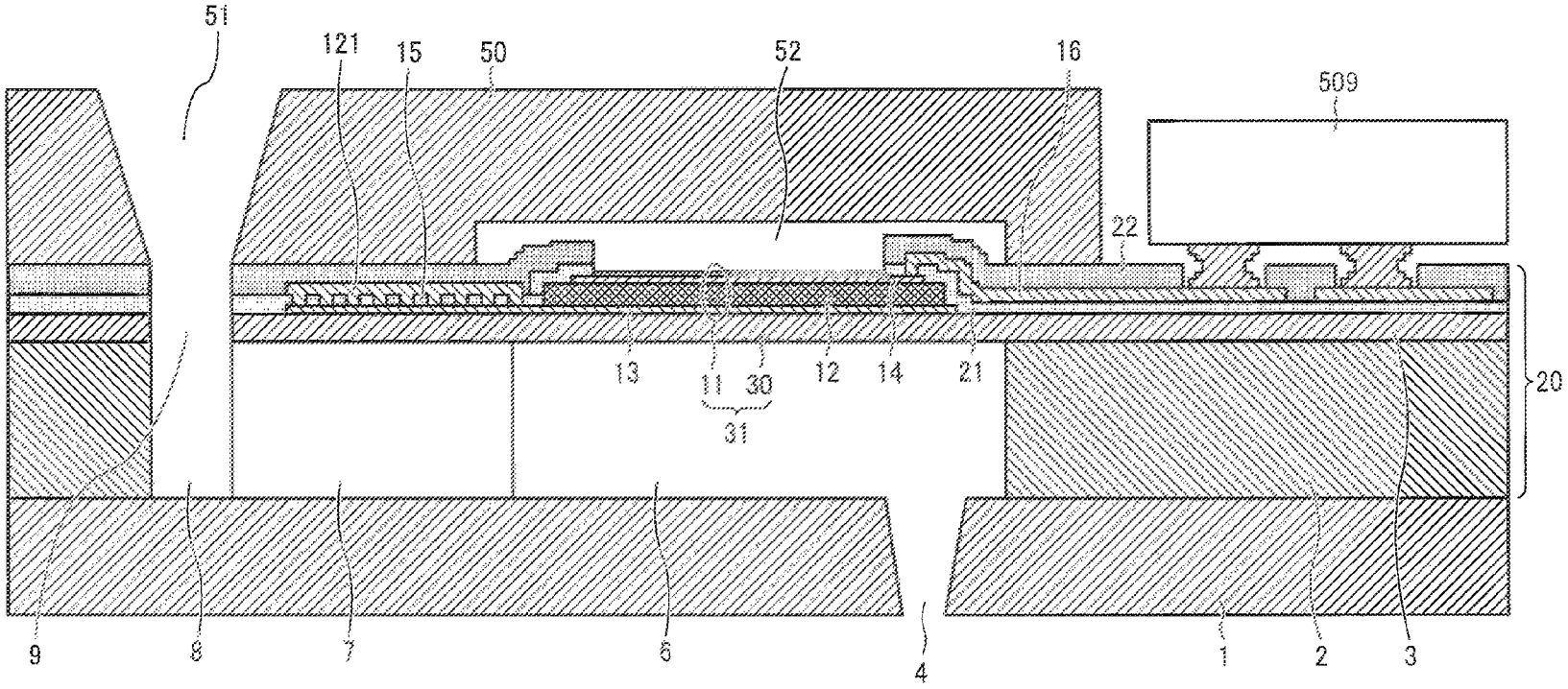
FIG. 5 is an enlarged cross-sectional view of a portion of the liquid discharge head of FIG. 2.
Figure 6:
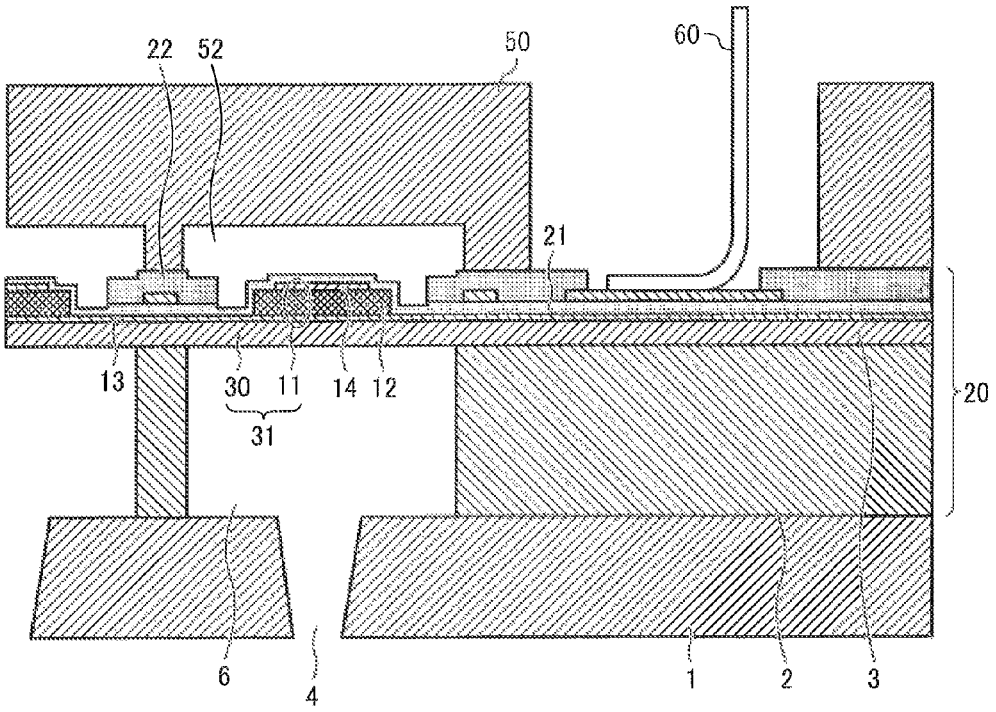
FIG. 6 is a cross-sectional view of a portion of the liquid discharge head of FIG. 2 cut along the nozzle array direction.

A liquid discharge head according to an embodiment of the present disclosure is described with reference to FIGS. 3 to 6, FIG. 3 is an exploded perspective view of the liquid discharge head according to an embodiment of the present disclosure. FIG. 4 is a cross-sectional view of the liquid discharge head of FIG. 3 cut along a direction perpendicular to a nozzle array direction in which nozzles are arrayed in row. FIG. 5 is an enlarged cross-sectional view of a portion of the liquid discharge head of FIG. 2. FIG. 6 is a cross-sectional view of a portion of the liquid discharge head of FIG. 2 cut along the nozzle array direction.

A liquid discharge head 404 according to the present embodiment includes a nozzle plate 1, a channel plate 2, a diaphragm plate 3 as a wall member, piezoelectric elements 11 as pressure generating elements (pressure generators), a holding substrate 50, a wiring member 60, and a frame substrate 70. The frame substrate 70 is also a common-liquid-chamber substrate.

In the present embodiment, the channel plate 2, the diaphragm plate 3, and the piezoelectric element 11 constitute an actuator substrate 20. Note that the actuator substrate 20 does not include the nozzle plate 1 or the holding substrate 50 that is bonded to the actuator substrate 20 after the actuator substrate 20 is formed as an independent component.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid inlets 8 communicated with the fluid restrictors 7.

The liquid inlets 8 are communicated with the common liquid chambers 10 in the frame substrate 70 via supply ports 9 of the diaphragm plate 3 and openings 51 as channels of the holding substrate 50.

The diaphragm plate 3 includes deformable vibration portions 30 forming part of walls of the individual liquid chambers 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator 31.

In the piezoelectric element 11, a common electrode 13 as a lower electrode, a piezoelectric layer (piezoelectric body) 12, and an individual electrode 14 as an upper electrode are laminated in this order from the vibration portion 30. An insulation film 21 is disposed on the piezoelectric element 11.

Note that, as illustrated in FIG. 4, the common electrode 13 for the plurality of piezoelectric elements 11 is a single electrode layer straddling all of the piezoelectric elements 11 in the nozzle array direction indicated by arrow NAD. A common-electrode power-supply wiring pattern 121 is connected to a portion 15 not constituting the piezoelectric element 11.

The individual electrodes 14 for the piezoelectric elements 11 are connected to a drive integrated circuit (driver IC) 509 (may also referred to as head driver in the circuit configuration) as a drive circuit via individual wires 16. The individual wire 16 is covered with an insulation film 22.

The driver IC 509 is mounted on the actuator substrate 20 by, e.g., a flip-chip bonding method, to cover an area between rows of the piezoelectric elements 11.

The holding substrate 50 is disposed on the actuator substrate 20.

The holding substrate 50 that forms part of walls of the common liquid chambers 10 is also a channel forming substrate that forms part of a channel from the common liquid chambers 10 to the individual liquid chambers 6. The holding substrate 50 also forms the openings 51 acting as channels passing through the common liquid chambers 10 and the individual liquid chambers 6 side.

The holding substrate 50 further has a function to hold the actuator substrate 20 and has openings 53 to accommodate driver ICs 509 and recesses 52 accommodating the piezoelectric elements 11.

The frame substrate 70 includes the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71 (see FIG. 1).

A damper unit 90 is bonded to the frame substrate 70. The damper unit 90 includes a damper 91 and damper plates 92. The damper 91 is deformable and forms part of walls of the common liquid chambers 10. The damper plates 92 reinforce the damper 91.

The frame substrate 70 is bonded to an outer peripheral portion of the nozzle plate 1, to accommodate the actuator substrate 20 and the holding substrate 50, thus forming a frame of the liquid discharge heads 404.

A cover 45 is disposed to cover a peripheral area of the nozzle plate 1 and a part of the outer circumferential face of the frame substrate 70.

In the liquid discharge heads 404, the driver IC 509 applies voltage between the common electrode 13 and the individual electrodes 14 of the piezoelectric actuator 31 of the piezoelectric element 11 to bend and deform the piezoelectric element 11. Thus, the vibration portion 30 bends towards the individual liquid chambers 6 and presses the liquid in the individual liquid chambers 6 so that the liquid is discharged through the nozzles 4.

Figure 7:
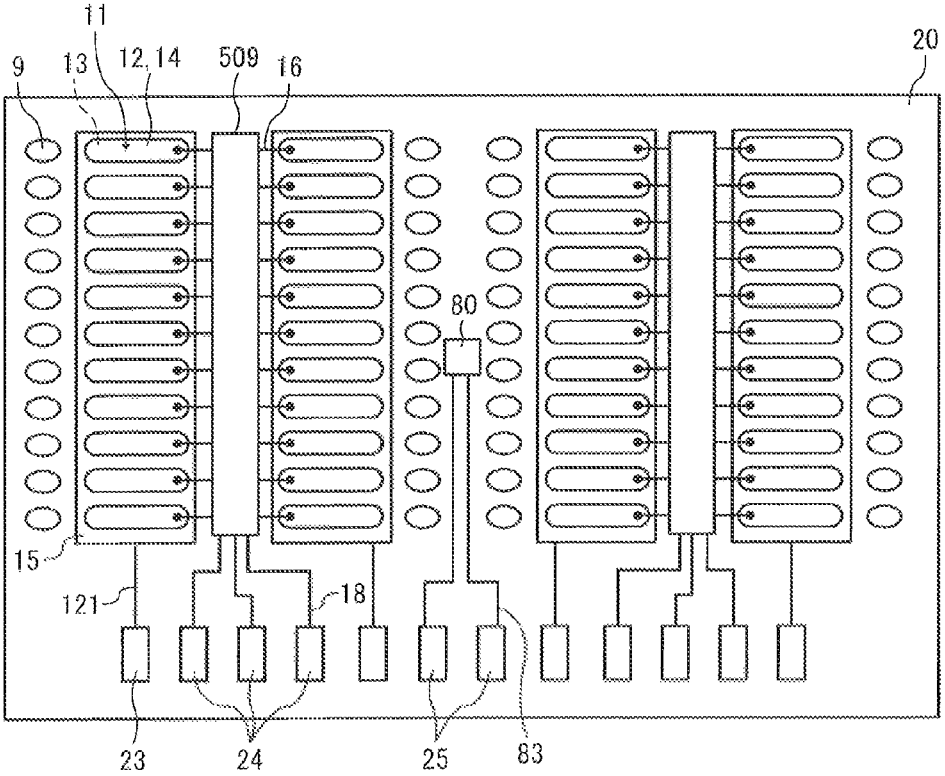
FIG. 7 is a plan view of an actuator substrate with a temperature detector of the liquid discharge head of FIG. 2.

Next, a temperature detector of the liquid discharge head is described with reference to FIG. 7. FIG. 7 is a plan view of the actuator substrate.

As described above, the actuator substrate 20 includes four piezoelectric element rows formed by arraying the plurality of piezoelectric elements 11 and the driver ICs 509 respectively disposed between two of the piezoelectric element rows.

On the actuator substrate 20, an electrode pad 23 and a plurality of electrode pads 24 are disposed. To the electrode pad 23, the common-electrode power-supply wiring pattern 121 connected to the portion 15 integrated with the common electrode 13 of the piezoelectric element 11 is connected, and the electrode pads 24 are connected to the driver IC 509 through wires 18. The plurality of electrode pads 24, for example, a drive waveform, data, clock signals, latch signals, and control signals are provided.

On the actuator substrate 20, a temperature detector 80 is disposed as a temperature detector to detect a temperature correlating a temperature of the head (temperature of the liquid discharge heads 404 in the present embodiment).

The temperature detector 80 is formed using the electrode layer forming the common electrode 13. The temperature detector 80 is connected to connecting pads 25 through lead wires 83.

Note that, the temperature detector 80 is described in an embodiment where the single temperature detector 80 is disposed at the center of the actuator substrate 20, but other arrangement is possible. The temperature detector 80 may be disposed at a position other than the center of the actuator substrate 20, and a plurality of the temperature detectors 80 may be disposed.

The temperature detector 80 can detect temperature from voltage values obtained by supplying constant current to the temperature detector 80 from an external circuit.

Figure 8:
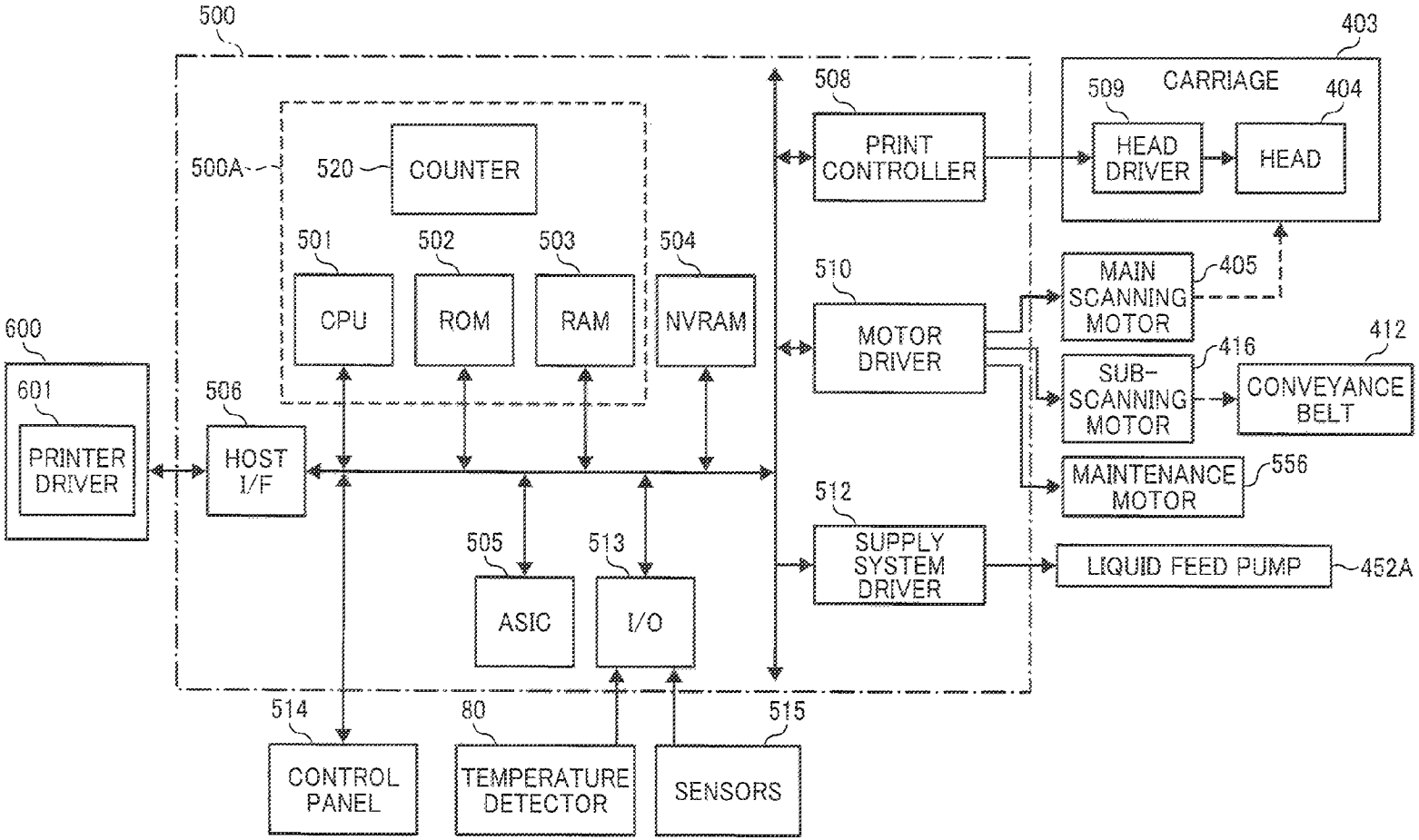
FIG. 8 is a block diagram of a controller of the liquid discharge apparatus of FIG. 1.

Next, an outline of a controller of the liquid discharge apparatus is described with reference to FIG. 8. FIG. 8 is a block diagram of the controller of the liquid discharge apparatus according to an embodiment of this disclosure.

In FIG. 8, the controller 500 includes a main controller 500A that includes a central processing unit (CPU) 501, a read-only memory (ROM) 502, and a random access memory (RAM) 503. The CPU 501 administrates the control of the entire liquid discharge apparatus 100. The ROM 502 stores fixed data, such as various programs including programs executed by the CPU 501, and the RAM 503 temporarily stores image data and other data.

The controller 500 includes a rewritable nonvolatile random access memory (NVRAM) 504 to retain data during the apparatus is powered off. The controller 500 includes an application specific integrated circuit (ASIC) 505 to perform image processing, such as various signal processing and sorting, on image data and process input and output signals to control the entire liquid discharge apparatus.

The controller 500 also includes a print controller 508 and a driver integrated circuit (hereinafter, head driver) 509. The print controller 508 includes a data transmitter, a driving signal generator, and a bias voltage output unit to drive and control the liquid discharge head 404. The head driver 509 drives the liquid discharge head 404.

The controller 500 further includes a motor driver 510 to drive a main scanning motor 405, a sub-scanning motor 416, and a maintenance motor 556. The main scanning motor 405 moves the carriage 403 for scanning, and the sub-scanning motor 416 circulates the conveyance belt 412. The maintenance motor 556 moves the cap 421 and the wiper 422 of the maintenance unit 420 and drives a suction device connected to the cap 421.

The controller 500 includes a supply-system driver 512 to drive a liquid feed pump 452A of a liquid feed unit 452.

The controller 500 includes an input-output (I/O) unit 513. The I/O unit 513 performs various sensor data and acquires detection signals from the temperature detector 80 of the liquid discharge head 404 and data from sensors 515 mounted in the liquid discharge apparatus 100. The I/O unit 513 also extracts data for controlling printing operation, and uses extracted data to control the print controller 508 and the motor driver 510.

The sensors 515 include, for example, an optical sensor to detect a position of a sheet material 410 and an interlock switch to detect the opening and closing of a cover.

The controller 500 is connected to a control panel 514 to input and display information necessary to the liquid discharge apparatus 100.

Here, the controller 500 includes an interface (I/F) 506 to send and receive data and signals to and from a host 600, such as an information processing apparatus (e.g., a personal computer) or an image reader. The controller 500 receives such data and signals from the host 600 with the I/F 506 via a cable or network.

The CPU 501 of the controller 500 reads and analyzes print data stored in a reception buffer of the I/F 506, performs desired image processing, data sorting, or other processing with the ASIC 505, and transfers image data from the print controller 508 to the head driver 509. For example, a printer driver 601 of the host 600 or the controller 500 creates dot-pattern data for image output.

The print controller 508 transfers the image data as serial data and outputs to the head driver 509, for example, transfer clock signals, latch signals, and control signals required for the transfer of image data and determination of the transfer.

The print controller 508 includes the driving signal generator including, e.g., a digital/analog (D/A) converter (to perform digital/analog conversion on pattern data of drive waveform), a voltage amplifier, and a current amplifier. The print controller 508 outputs a driving signal containing one or more driving pulses from the driving signal generator to the head driver 509.

In accordance with serially-inputted image data corresponding to one line recorded by the liquid discharge head 404, the head driver 509 selects driving pulses of a drive waveform transmitted from the print controller 508 and applies the selected driving pulses to the piezoelectric element 11 serving as the pressure generator to drive the liquid discharge head 404. Thus, the liquid discharge heads 404 are driven.

At this time, by selecting a part or all of one or more driving pulses (a part or all of waveform elements forming a driving pulse), the liquid discharge head 404 can selectively discharge dots of different sizes, e.g., large droplets, medium droplets, and small droplets.

Figure 9:
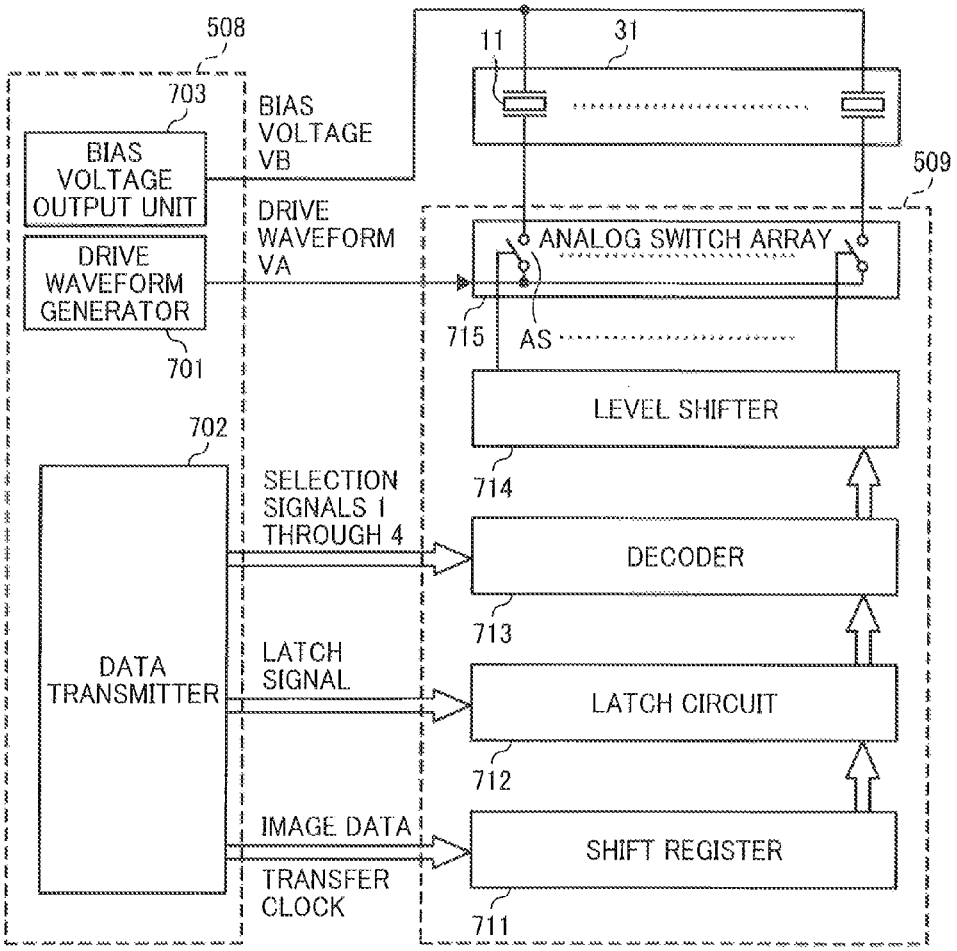
FIG. 9 is a block diagram of a portion relating to head drive control according to an embodiment of the present disclosure.

Next, a portion relating to head drive control according to an embodiment is described with reference to a block diagram illustrated in FIG. 9.

The print controller 508 includes a drive waveform generator 701 as a drive waveform generator to generate and output a drive waveform VA. The print controller 508 also includes a data transmitter 702 to output image data of two bits (gradation signals 0 and 1) corresponding to a print image, clock signals, latch signals, and selection signals for selecting driving pulses contained in a common drive waveform.

The print controller 508 also includes a bias voltage output unit 703 to output bias voltage VB to the common electrode 13 of the piezoelectric element 11.

The drive waveform generator 701 generates and outputs the drive waveform VA in which a plurality of driving pulses (drive signals) for discharging liquid in one printing period is arranged in time series (one drive period).

The selection signals instruct opening and closing of an analog switch AS for each droplet. The analog switch AS is a switching unit of the head driver 509. The selection signals transit the states to the level H (ON) for a driving pulse (or waveform element) to be selected and to the level L (OFF) for a driving pulse not to be selected in accordance with a printing period of the drive waveform VA.

The head driver 509 includes a shift register 711, a latch circuit 712, a decoder 713, a level shifter 714, and an analog switch array 715.

To the shift register 711, transfer clock (shift clock) and serial image data (gradation data: two bits/one channel (one nozzle)) are input from the data transmitter 702. The latch circuit 712 latches each resist value of the shift register 711 corresponding to latch signals.

The decoder 713 decodes the gradation data and the selection signals to output the result of decoding. The level shifter 714 performs level conversion of the voltage signals of the decoder 713 at a logic level to a level allowing the analog switch AS of the analog switch array 715 to operate.

The analog switch AS of the analog switch array 715 is turned on/off (opened and closed) corresponding to the output from the decoder 713 provided through the level shifter 714.

The analog switch AS of the analog switch array 715 is connected to the individual electrode 14 of the piezoelectric element 11, and to the analog switch AS, the drive waveform VA from the drive waveform generator 701 is input. Thus, the analog switch AS is turned on corresponding to the result of decoding the image data (gradation data) and the selection signals, which have been serially transferred, by the decoder 713. Thus, driving pulses (or waveform elements) contained in the drive waveform VA pass (are selected) and are supplied to the individual electrode 14 of the piezoelectric element 11.

Meanwhile, bias voltage VB output from the bias voltage output unit 703 is supplied to the common electrode 13 that is opposite of a piezoelectric layer 12 from the individual electrode 14, to which selected driving pulses (drive signals containing waveform element part only) from the drive waveform VA of the piezoelectric element 11 are supplied.

The main controller 500A includes temperature table for adjusting bias voltage. The temperature table contains correction values (adjustment values) of the bias voltage VB relative to temperature of the head. The main controller 500A provides voltage data after correction (variation) of the bias voltage VB according to temperature of the head detected by the temperature detector 80 to the bias voltage output unit 703. The bias voltage output unit 703 outputs the bias voltage VB corresponding to the voltage data provided from the main controller 500A.

The main controller 500A includes a drive time table for adjusting bias voltage. The drive time table contains correction values (adjustment values) of the bias voltage VB relative to cumulative time of head drive time (cumulative drive time). The main controller 500A provides voltage data obtained by further correcting (varying) the bias voltage VB after the correction based on temperature of the head based on cumulative drive time to the bias voltage output unit 703. The bias voltage output unit 703 outputs the bias voltage VB corresponding to the voltage data provided from the main controller 500A.

Note that, one a temperature table for adjusting bias voltage containing voltage values of the bias voltage VB relative to temperature of the head and a drive time table for adjusting bias voltage containing voltage values of the bias voltage VB relative to cumulative drive time may be stored. However, a table of correction values (voltage magnifications) may be preferably used when correction is performed several times.

Next, relation between a drive waveform and bias voltage according to the embodiment is described with reference to FIG. 10.

Figure 10:
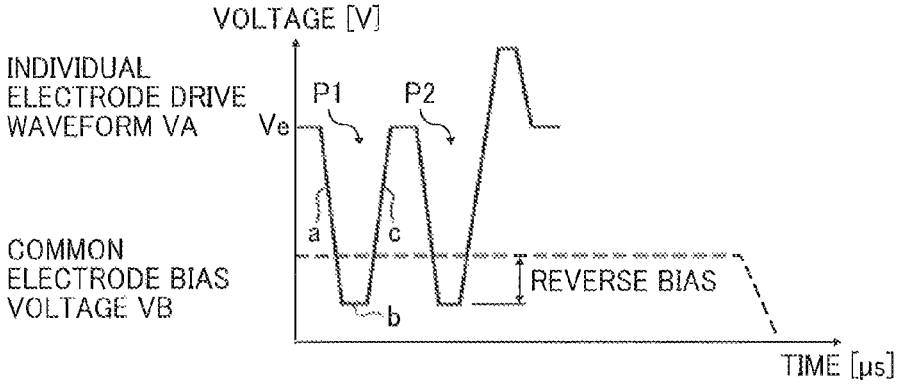
FIG. 10 is an illustration of the relation between a drive waveform to be applied to individual electrodes and bias voltage to be applied to a common electrode according to an embodiment of the present disclosure.

The drive waveform generator 701 generates and outputs the drive waveform VA, for example, containing a plurality of (two in the present embodiment) driving pulses P1 and P2 as illustrated in FIG. 10. Drive waveform data of the drive waveform VA is stored and held in the ROM 502, for example.

Part or all of the driving pulses P1 and P2 contained in the drive waveform VA is selected and supplied to the individual electrode 14 of the specified piezoelectric element 11. Note that, in the present embodiment, it is assumed that both of the driving pulses P1 and P2 contained in the drive waveform VA are supplied to the individual electrode 14 for convenience of explanation.

Meanwhile, the bias voltage output unit 703 outputs the bias voltage VB that is a reverse bias relative to the driving pulses P1 and P2 (a reverse bias voltage with respect to the piezoelectric element 11), and the bias voltage VB is applied to the common electrode 13, which is common for the respective piezoelectric elements 11.

The driving pulses P1 and P2 contained in the drive waveform VA have the intermediate potential Ve as a reference potential and each contain an expansion waveform element (pull-in waveform element) a falling from the intermediate potential Ve to a predetermined potential, a hold waveform element b holding the potential after falling, and a shrinkage waveform element (push-in waveform element) c rising from the held potential to a predetermined potential (the intermediate potential Ve in the present embodiment).

The drive waveform VA varies a waveform shape in a predetermined temperature range, and even when the wave form shape is not varied, a voltage value (driving voltage value), for example, is corrected according to a voltage magnification corresponding to a change of temperature of the head.

The bias voltage VB is now varied corresponding to the temperature of the head detected by the temperature detector 80. In the present embodiment, the bias voltage VB is varied such that voltage that maximizes discharge speed of liquid the maximum at the detected temperature of the head is output as the bias voltage VB.

Next, P-E (power-electric field) hysteresis property of a piezoelectric element relative to temperature is described with reference to FIG. 11.

Figure 11:
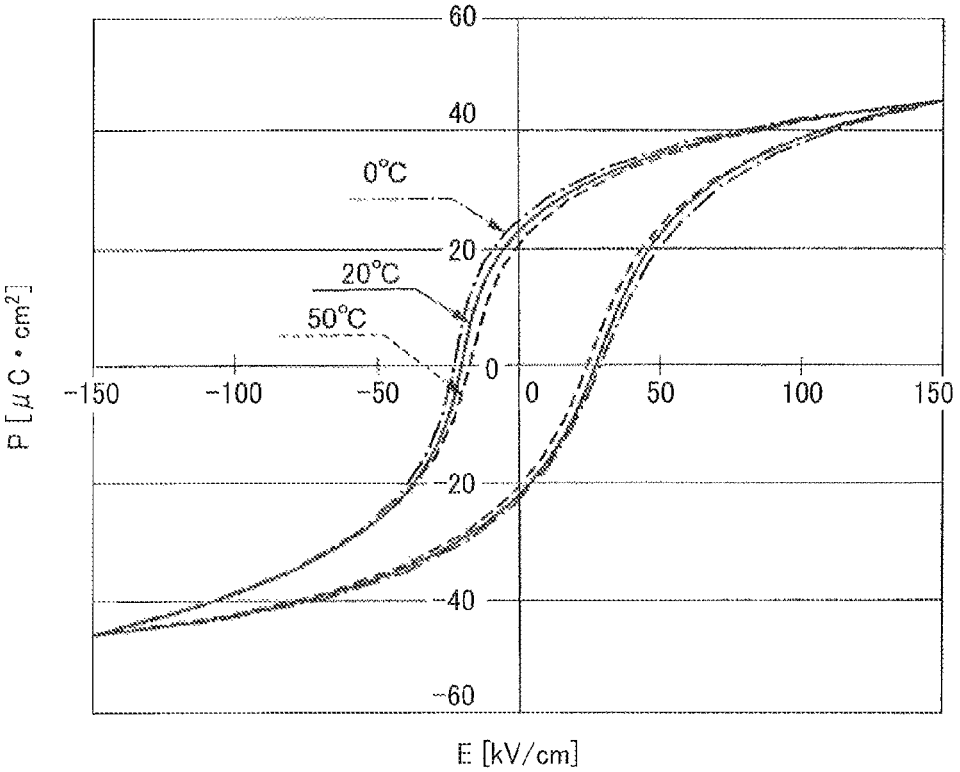
FIG. 11 is a graph of P-E (power-electric field) hysteresis property of a piezoelectric element relative to temperature according to an embodiment of the present disclosure.

FIG. 11 illustrates P-E hysteresis property of a piezoelectric element at temperatures 0 degree C., 20 degree C. and 30 degree C. As temperature varies, the P-E hysteresis property varies, and then optimal property of the bias voltage VB varies.

Thus, temperature of the head is detected and voltage values of the bias voltage VB are corrected (varied) based on the detected temperature of the head, so that variation of the displacement amount depending on temperature of the head can be suppressed and stable driving is possible.

It is known that when a voltage waveform beyond positive coercive electric field is applied to a piezoelectric element, drive time and P-E, hysteresis property of the piezoelectric element both vary.

Therefore, correcting (varying) voltage values of the bias voltage VB corresponding to head drive time allows more stable driving.

Figure 12:
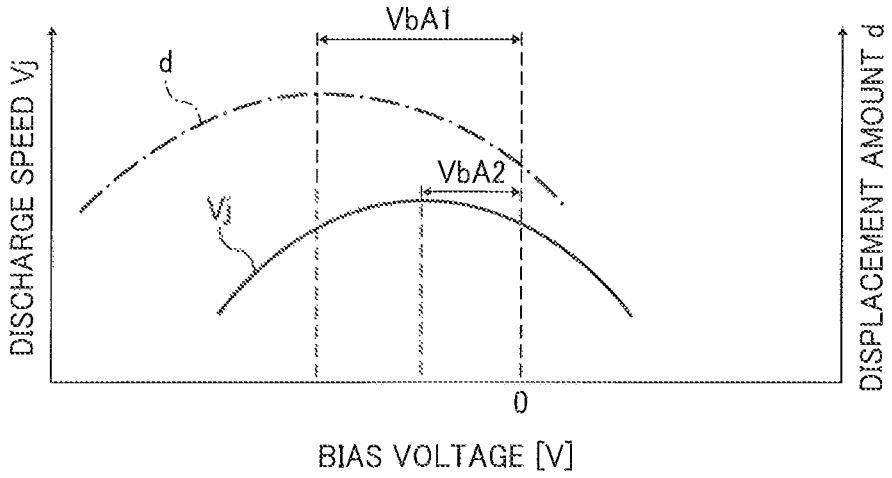
FIG. 12 is a graph of the relation between bias voltage, liquid discharge speed, and displacement amount of a piezoelectric element according to an embodiment of the present disclosure.

Next, a variation range of voltage values of bias voltage is described also with reference to FIG. 12. FIG. 12 is an illustration of the relation between bias voltage, liquid discharge speed, and displacement amount of a piezoelectric element according to an embodiment.

In this example, liquid discharge speed and displacement amount of the piezoelectric element are measured while a rectangular wave of Vpp: 20 V is applied to the individual electrode 14 and voltage values of the bias voltage VB applied to the common electrode 13 are varied. As a result, the bias voltage YB that maximizes the displacement amount of the piezoelectric element is −4.5 V while the bias voltage VB maximizes liquid discharge speed is −3.5 V.

In the example of FIG. 12, as bias voltage values of the bias voltage VB are increased with 0 V (ground potential) as a reference, the displacement amount d is increased in a range VbA1. As bias voltage values of the bias voltage YB are increased with 0 V (ground potential) as a reference, liquid discharge speed Vj is increased in a range VbA2.

However, increase of the bias voltage values beyond the range VbA2 increases the displacement amount d but decreases the liquid discharge speed Vj.

Thus, the bias voltage value maximizing the displacement amount of the piezoelectric element deviates from the bias voltage value maximizing the liquid discharge speed.

Thus, the voltage value of the bias voltage is preferably changed in a voltage-value range in which the liquid discharge speed is higher when the bias voltage is applied with the voltage value than when no bias voltage is applied.

In addition, it has been found that the bias voltage maximizing liquid discharge speed is determined from a characteristic value corresponding to a power component of the piezoelectric element together with the displacement amount of the piezoelectric element.

The characteristic value corresponding to the power component of the piezoelectric element varies corresponding to the temperature of the head as described above as well as cumulative drive time of the head (piezoelectric element). Therefore, the bias voltage value maximizing liquid discharge speed can be obtained by detecting temperature of the head and cumulative drive time of the piezoelectric element.

Thus, in the present embodiment, the temperature detector 80 detects temperature of the head. In addition, cumulative time of drive time (drive cumulative time) of the liquid discharge head 404 is measured using a counter 520 included in the main controller 500A.

Here, characteristic variation with the drive time of the head strongly correlates with time length in which voltage beyond the positive coercive electric field is applied. In this case, characteristic variation is affected by applied voltage, but a time length in which the intermediate potential Ye is maintained has the strongest correlation with characteristic variation amount because the time length is longest when the head is driven by applying a waveform in which voltage is retained at the intermediate potential and then transits to a specified voltage as the drive waveform VA to be supplied to the individual electrodes 14.

Therefore, the head drive time is set to cumulative time of time elapsed while the individual electrodes 14 are raised to the intermediate potential Ve.

Figure 13:
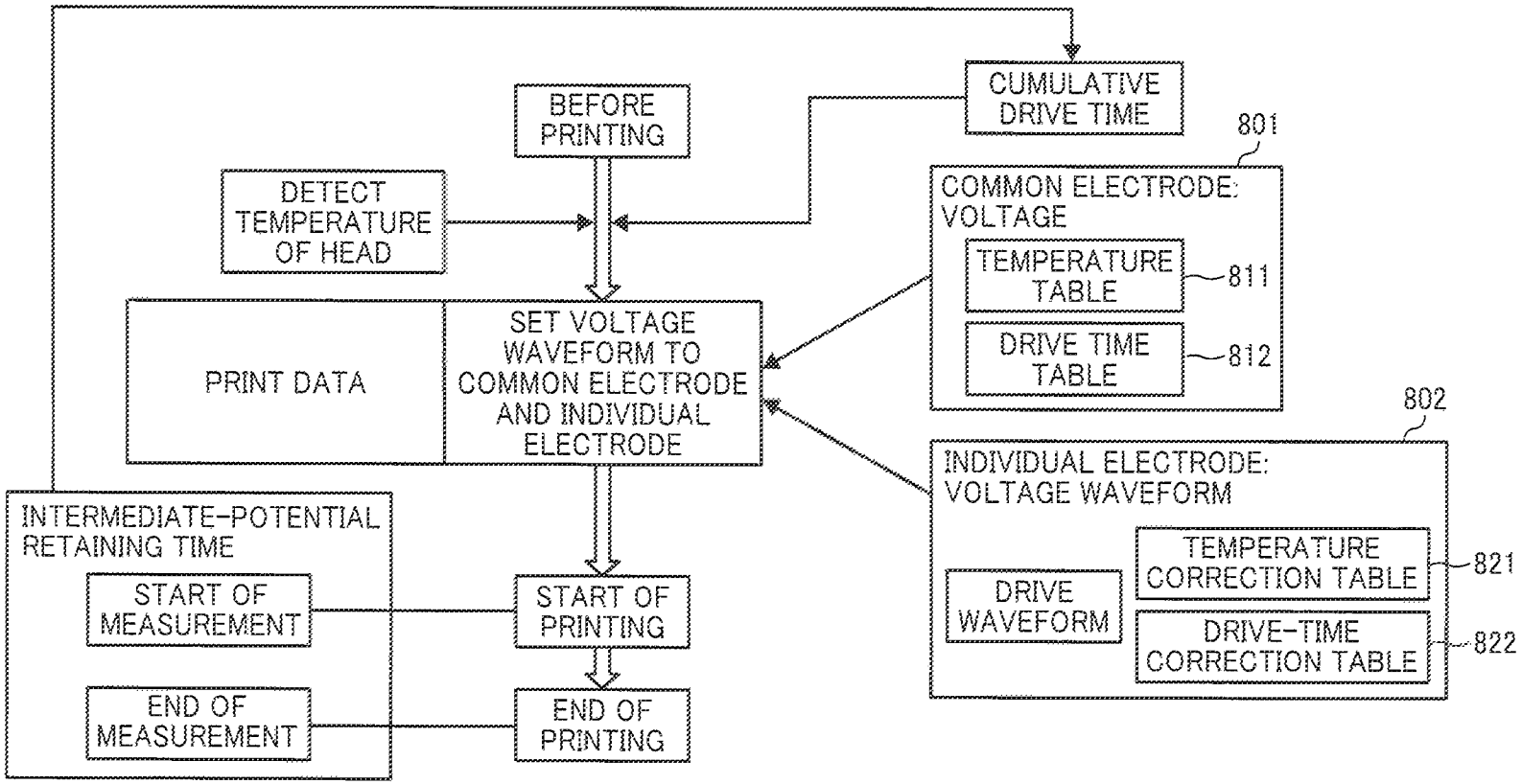
FIG. 13 is a flow diagram of an example of voltage control of the liquid discharge apparatus of FIG. 1 according to an embodiment of the disclosure.

Next, voltage control in the liquid discharge apparatus is described with reference to a flow diagram of FIG. 13.

In the present embodiment, a common-electrode voltage-data storage 801 and a individual-electrode voltage-waveform-data storage 802 are realized by the ROM 502 of the main controller 500A.

The common-electrode voltage-data storage 801 holds a temperature table 811 and a drive time table 812 in addition to voltage data of the bias voltage VB to be applied to the common electrode 13. The temperature table 811 contains correction coefficients for varying (adjusting) a voltage value of the bias voltage VB based on temperature of the head. The drive time table 812 contains correction coefficients for varying (adjusting) a voltage value of the bias voltage VB based on cumulative drive time.

The individual-electrode voltage-waveform-data storage 802 holds a temperature correction table 821 and a drive-time correction table 822 in addition to data of the drive waveform VA to be provided to the individual electrodes 14. The temperature correction table 821 contains correction coefficients for varying (adjusting) a voltage value of the drive waveform VA based on temperature of the head. The drive-time correction table 822 contains correction coefficients for varying (adjusting) a voltage value of the drive waveform VA based on cumulative drive time.

Before print operation is started, the temperature detector 80 detects temperature of the head, and the main controller 500A reads data of cumulative drive time stored and held in the NVRAM 504. The main controller 500A sets the voltage data of the bias voltage VB to the bias voltage output unit 703. The voltage data has been corrected based on temperature of the head and cumulative drive time, and is to be applied to the common electrode 13. The main controller 500A also sets the voltage waveform data of the drive waveform VA to the drive waveform generator 701. The voltage waveform has been corrected based on temperature of the head and cumulative drive time, and is to be supplied to the individual electrodes 14.

Thus, the bias voltage VB after correction based on temperature of the head and cumulative drive time is applied from the bias voltage output unit 703 to the common electrode 13 of the piezoelectric element 11 of the piezoelectric actuator 31.

For printing, the drive waveform generator 701 supplies the drive waveform VA after correction based on temperature of the head and cumulative drive time to the head driver 509 and provides driving pulses selected corresponding to image data to the individual electrodes 14 of the piezoelectric element 11 for each printing period.

Printing is then started based on the print data. Upon start of printing, the time length from time when the individual electrodes 14 start to be retained at the intermediate potential Ve to time when the voltage of the individual electrodes 14 falls from the intermediate potential Ve is measured. The time length is added to the cumulative drive time and the obtained cumulative drive time is stored and held.

Variation of bias voltage to be applied to a common electrode of a piezoelectric element corresponding to temperature of a head can suppress variation of displacement property due to variation of temperature of the head and then drive a piezoelectric actuator to have stable displacement property.

Note that, in the above-described embodiment, the apparatus that drives the piezoelectric actuator 31 including the piezoelectric element 11 includes parts of the head driver 509 and the controller 500 related to generation of a drive waveform, generation of bias voltage, and correction based on temperature of the head, for example.

In the present embodiment, temperature of the head is directly detected as temperature correlating to the temperature of the head, but environmental temperature of the apparatus may be used as temperature correlating to the temperature of the head.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, a liquid discharge apparatus to discharge liquid to form an image on a medium or a solid fabricating apparatus (three-dimensional fabricating apparatus) to discharge a fabrication liquid to a powder layer in which powder is formed in layers to form a solid fabricating object (three-dimensional object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described material to which liquid can adhere may include any material to which liquid may adhere even temporarily. The material to which liquid can adhere may be, e.g., paper, thread, fiber, fabric, leather, metal, plastics, glass, wood, or ceramics, to which liquid can adhere even temporarily.

The liquid may be, e.g., ink, treatment liquid, DNA sample, resist, pattern material, binder, or mold liquid.

The liquid discharge apparatus may be, unless in particular limited, any of a serial-type apparatus to move the liquid discharge head and a line-type apparatus not to move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 2. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head including a piezoelectric element to generate pressure to discharge liquid through a nozzle;

a temperature detector to detect a temperature correlating to a temperature of the piezoelectric element;

a drive signal generator to generate a drive signal for driving the discharge of the liquid by the liquid discharge head; and a bias voltage applying unit to apply a bias voltage to a first electrode of the piezoelectric element opposite a second electrode to which a drive signal is applied, the bias voltage applying unit adjusting the bias voltage according to a detection result of the temperature detector, wherein the bias voltage applying unit applies, as the bias voltage, a voltage of a reverse bias with respect to the piezoelectric element.

2. The liquid discharge apparatus according to claim 1, wherein the bias voltage applying unit changes a voltage value of the bias voltage in a range in which a liquid discharge speed is higher when the bias voltage is applied with the voltage value than when no bias voltage is applied.

3. The liquid discharge apparatus according to claim 1, further comprising a table that contains a voltage value or a correction value of the bias voltage corresponding to the temperature correlating to the temperature of the piezoelectric element.

4. The liquid discharge apparatus according to claim 1, further comprising a counter to measure a drive time of the piezoelectric element, wherein the bias voltage applying unit changes the bias voltage according to a measurement result of the drive time.

5. The liquid discharge apparatus according to claim 4, further comprising a table that contains a voltage value or a correction value of the bias voltage corresponding to the drive time.

6. The liquid discharge apparatus according to claim 1, wherein the temperature detector is disposed on the liquid discharge head.

7. The liquid discharge apparatus according to claim 1, wherein the voltage of the reverse bias has a higher potential than a lowest potential of the drive signal applied to the second electrode.

8. The liquid discharge apparatus according to claim 1, wherein the bias voltage applying unit includes:

a bias voltage output unit to output the bias voltage to the first electrode of the piezoelectric element; and a main controller to adjust the bias voltage according to the detection result of the temperature detector and to provide the adjusted bias voltage to the bias voltage output unit.

9. A liquid discharge apparatus comprising:

a liquid discharge head including a piezoelectric element to generate pressure to discharge liquid through a nozzle;

a temperature detector to detect a temperature correlating to a temperature of the piezoelectric element;

a bias voltage applying unit to apply a bias voltage to a first electrode of the piezoelectric element opposite a second electrode to which a drive signal is applied, the bias voltage applying unit to change the bias voltage according to a detection result of the temperature detector; and a counter to measure a drive time of the piezoelectric element, wherein the bias voltage applying unit changes the bias voltage according to a measurement result of the drive time, wherein a drive waveform including the drive signal is a driving voltage that varies from an intermediate potential as a reference, and wherein the drive time is a time period in which the driving voltage is maintained at the intermediate potential.

10. The liquid discharge apparatus according to claim 9, wherein the bias voltage applying unit applies, as the bias voltage, a voltage of a reverse bias with respect to the piezoelectric element.

11. The liquid discharge apparatus according to claim 10, wherein the bias voltage applying unit changes a voltage value of the bias voltage in a range in which a liquid discharge speed is higher when the bias voltage is applied with the voltage value than when no bias voltage is applied.

12. The liquid discharge apparatus according to claim 10, wherein the voltage of the reverse bias has a higher potential than a lowest potential of the drive signal applied to the second electrode.

13. The liquid discharge apparatus according to claim 9, further comprising a table that contains a voltage value or a correction value of the bias voltage corresponding to the temperature correlating to the temperature of the piezoelectric element.

14. The liquid discharge apparatus according to claim 9, further comprising a table that contains a voltage value or a correction value of the bias voltage corresponding to the drive time.

15. The liquid discharge apparatus according to claim 9, wherein the temperature detector is disposed on the liquid discharge head.

16. The liquid discharge apparatus according to claim 9, wherein the bias voltage applying unit includes:

a bias voltage output unit to output the bias voltage to the first electrode of the piezoelectric element; and a main controller to adjust the bias voltage according to the detection result of the temperature detector and to provide the adjusted bias voltage to the bias voltage output unit.

17. A piezoelectric-actuator driving device to drive comprising:

a piezoelectric actuator including a piezoelectric element;

a temperature detector to detect a temperature correlating to a temperature of the piezoelectric element;

a drive signal generator to generate a drive signal for driving the piezoelectric-actuator; and a bias voltage applying unit to apply the bias voltage to a first electrode of the piezoelectric element opposite a second electrode to which a drive signal is applied, the bias voltage being a reverse bias voltage with respect to the piezoelectric element, the bias voltage applying unit adjusting the bias voltage according to a detection result of the temperature detector.

18. The piezoelectric-actuator driving device according to claim 17, wherein the bias voltage applying unit includes:

a bias voltage output unit to output the bias voltage to the first electrode of the piezoelectric element; and a main controller to adjust the bias voltage according to the detection result of the temperature detector and to provide the adjusted bias voltage to the bias voltage output unit.

* * * * *